US005476531A

United States Patent [19]

Timm et al.

[11] Patent Number: 5,476,531

[45] Date of Patent: Dec. 19, 1995

[54] RHENIUM-BOUND TUNGSTEN CARBIDE COMPOSITES

[75] Inventors: Edward E. Timm, Freeland; Ann M. Gulau, Midland, both of Mich.

[73] Assignee: The Dow Chemical Company, Midland, Mich.

[21] Appl. No.: 256,830

[22] PCT Filed: Feb. 20, 1992

[86] PCT No.: PCT/US92/01355

§ 371 Date: Jul. 26, 1994

§ 102(e) Date: Jul. 26, 1994

[87] PCT Pub. No.: WO93/17141

PCT Pub. Date: Sep. 2, 1993

[51] Int. Cl.[6] ..... C22C 29/08; C22C 29/10

[52] U.S. Cl. ..... 75/240

[58] Field of Search ..... 75/240, 241

[56] References Cited

U.S. PATENT DOCUMENTS

| | | | |
|---|---|---|---|
| Re. 31,355 | 8/1983 | Rozmus | 419/49 |
| 1,831,567 | 11/1931 | Kelley | 75/240 |
| 4,067,742 | 1/1978 | Fletcher et al. | 106/43 |
| 4,255,103 | 3/1981 | Rozmus | 425/78 |
| 4,428,906 | 1/1984 | Rozmus | 419/48 |
| 4,432,794 | 2/1984 | Holleck | 75/239 |
| 4,656,002 | 4/1987 | Lizenby et al. | 419/10 |
| 4,923,512 | 5/1990 | Timm et al. | 75/239 |
| 4,945,073 | 7/1990 | Dubensky et al. | 501/93 |
| 5,089,447 | 2/1992 | Timm et al. | 501/87 |
| 5,215,945 | 6/1993 | Dubensky et al. | 501/94 |
| 5,223,460 | 6/1993 | Dubensky et al. | 501/94 |
| 5,256,608 | 10/1993 | Dubensky et al. | 501/94 |

FOREIGN PATENT DOCUMENTS

| | | | |
|---|---|---|---|
| 2350403 | 4/1977 | France . | |
| 9413419 | 6/1994 | WIPO | 3/12 |

*Primary Examiner*—Ngoclan Mai

[57] ABSTRACT

Rhenium metal is used as the sole binder metal in preparing hard metals based upon tungsten carbide, titanium carbide or hafnium carbide. The resultant hard metals can be used in conventional applications such as cutting tools.

4 Claims, No Drawings

RHENIUM-BOUND TUNGSTEN CARBIDE COMPOSITES

This invention generally concerns cemented refractory metal matrix composites. This invention particularly concerns rhenium-bound tungsten carbide, rhenium-bound hafnium carbide and rhenium-bound titanium carbide metal matrix composites. This invention more particularly concerns the use of substantially pure rhenium metal as a binder for tungsten carbide, hafnium carbide or titanium carbide.

Cemented carbides, also known as "hard metals", conventionally include a basic carbide, such as tungsten carbide, and an iron group metal, such as cobalt, as a binder. U.S. Pat. No. 4,432,794 discloses binder metal alloys that comprise a solid alloy of a transition metal of Group IVb, Vb or VIb with Re, Ru, Rh, Pd, Os, Ir or Pt. Lisovsky et al., in "Structure of a Binding Phase in Re-Alloyed WC-Co Cemented Carbides", *Refractory Metals & Hard Materials,* Volume 10 (1991), pages 33–36, discuss the effects of alloying WC-Co cemented carbides with rhenium.

Tools made of cemented carbide, including WC-Co (tungsten carbide-cobalt) as a typical composition, are widely used in the machining field. The alloy compositions, characteristics, uses and applications of such cemented carbide materials are summarized in *Cemented Carbides for Engineers and Tool Users,* International Carbide Data (1983 ).

SUMMARY OF THE INVENTION

The present invention is a dense refractory composition-consisting essentially of rhenium in an amount within a range of from 1 to 25 percent by weight of composition and a refractory metal carbide selected from tungsten carbide, hafnium carbide and titanium carbide in an amount within a range of from 75 to 99 percent by weight of composition.

The dense refractory compositions can be used in any one of a number of conventional applications for hard metals. One such application is as a cutting tool used in machining or cutting a variety of materials such as metals, plastics and wood products. Cutting tools include indexable inserts, end mills, router bits, reamers, drills, saw blades and knives.

DESCRIPTION OF PREFERRED EMBODIMENTS

The refractory metal carbide is suitably tungsten carbide, hafnium carbide or titanium carbide. Tungsten carbide yields particularly desirable results. The tungsten carbide has an average grain size that is suitably about ten micrometers or less, beneficially about five micrometers or less, desirably about one micrometer or less, and preferably from 0.4 to 0.8 micrometer. Acceptable grain sizes for other carbides approximate those for tungsten carbide and can be readily determined without undue experimentation. The refractory metal is preferably in powder or particulate form.

Rhenium metal powder suitable for purposes of the present invention has a particle size that is desirably about five micrometers or less and preferably from about two to about three micrometers (μm).

Rhenium metal powder and a refractory metal carbide powder are suitably converted to a powdered admixture by any one of a number of conventional mixing processes. The use of an attritor, wherein balls of a hard material, such as tungsten carbide/cobalt, are used to facilitate mixing, provides particularly satisfactory results.

The powdered admixture consists essentially of rhenium metal powder and a refractory metal carbide powder. In other words, no additional binder metal, such as cobalt, is needed. The rhenium metal powder is present in an amount within a range of from 1 to 25 percent by weight, based upon powdered admixture weight. The refractory metal carbide powder is present in an amount within a range of from 75 to 99 percent by weight, based upon powdered admixture weight. Desirable amounts of rhenium metal powder and refractory metal carbide powder are, respectively, from 5 to 20 and from 95 to 80 percent by weight of composition. Preferred amounts of rhenium metal powder and refractory metal carbide powder are, respectively, from 6 to 18 and from 94 to 82 percent by weight of composition. The amounts of rhenium metal powder and refractory metal carbide powder total 100 percent.

Mixing of the powders in an attritor is beneficially accomplished with the aid of a liquid or solvent such as heptane. In order to facilitate greenware formation subsequent to mixing, a binder such as paraffin wax can be added during the final stages of attrition. The attrited mixture is desirably dried before further processing. Particularly satisfactory results are obtained by screening or classifying the attrited and dried mixture to remove unwanted agglomerates and fines.

Selection of a procedure for conversion of the screened powder mixture is not particularly critical and depends largely upon desired shape of the greenware. Uniaxial pressing in hard tooling, dry or wet bag cold isostatic pressing in rubber tooling, extrusion and injection molding are all used to form greenware in the hardmetals industry. For purposes of the present invention, uniaxial pressing in hard tooling, and dry or wet bag cold isostatic pressing in rubber tooling produce satisfactory results.

Before a pressed greenware article can be consolidated, it must first be processed to remove binders. In addition, thermal processing can be used, with a reducing gas such as hydrogen, to remove some metal oxides. At temperatures greater than those used to remove metal oxides, thermal processing provides preliminary, but limited or incomplete, densification by sintering. The term "incomplete densification" means that the greenware article, following thermal processing, has a density that is less than about 10%, typically 1–3%, greater than that of the greenware article prior to thermal processing. These processes are beneficially accomplished by programmed heating in a furnace under vacuum up to a temperature of about 350° C. for dewaxing or binder removal, then under a hydrogen atmosphere over a temperature range of from 350° C. to 525° C. to remove metal oxides and then under a vacuum at a temperature of about 1400° C. for a period of about two hours to partially sinter, or accomplish incomplete densification of, the greenware. The dewaxed parts are then desirably wrapped in graphite foil to facilitate part recovery following densification.

Densification or consolidation of the dewaxed greenware is suitably accomplished by a procedure known as Rapid Omnidirectional Compaction (hereinafter "ROC"). ROC, as described by C. A. Kelto et al., in "Rapid Omnidirectional Compaction (ROC) of Powder", *Annual Review of Material Science,* Volume 19, pages 527–50 (1989), is a quasi-isostatic consolidation process used to densify powders or cold-pressed preforms. The process employs a conventional forging press and closed-die tooling to apply pressure to a preheated assembly called a fluid die.

U.S. Pat. No. 4,744,943, at column 5, line 13 through column 6, line 15, discloses pressure transmitting media and combinations of pressure, temperature and time used in a typical ROC process. Pressure transmitting media include glass and certain salts that are flowable at pressures and temperatures used for consolidation. Boron-containing glass and Vycor™ Number 7913 brand glass are preferred pressure transmitting media. Temperatures range from 400° C. to 2900° C. Pressures range from 10,000 psi (68.9 megapascals (MPa)) to a pressure at which the material being consolidated fractures (also known as the "fracture point"). The pressures are desirably between 50,000 psi (345 MPa) and the fracture point, preferably between 70,000 psi (482 MPa) and the fracture point and most preferably between 100,000 psi (689 MPa) and the fracture point. The maximum pressure is preferably less than about 500,000 psi (3450 MPa). Time at pressure is sufficient for the material being consolidated to reach at least 85 percent of its theoretical density. The time ranges from 0.01 second to 1 hour and is beneficially less than 30 minutes, desirably less than about 10 minutes, preferably less than about 1 minute and most preferably less than about 20 seconds.

Prior to forging, the fluid die assembly containing the greenware is heated in an inert atmosphere to a temperature that is sufficient to yield a desired density. Suitable temperatures for tungsten carbide/rhenium admixtures range from 1600° C. to 1900° C. Desirable temperatures range from 1650° C. to 1800° C. Temperatures for admixtures wherein hafnium carbide or titanium carbide replace tungsten carbide are readily determined without undue experimentation.

Following forging or densification, the fluid die assembly containing refractory metal/rhenium parts are suitably air cooled to ambient temperature. The parts are then recovered from the die assembly by conventional means.

The densified parts suitably have a density greater than about 98 percent of theoretical density. "Theoretical density" is based upon a straight line rule of mixtures. The density is desirably greater than about 99 percent of theoretical density. The density is preferably about 100 percent of theoretical density.

The following examples illustrate the present invention. They do not, either expressly or implicitly, limit the scope of the invention. All parts and percentages are by weight unless otherwise stated.

EXAMPLE 1

Tungsten carbide (87.52%) and rhenium metal (12.48%) powders are mixed in an attritor for four hours using tungsten carbide-cobalt milling media and heptane as a solvent. Paraffin wax (2%) is added to act as a greenware binder. The resultant mixture is dried and screened through a 20 mesh (Tyler equivalent designation) (850 μm sieve aperture) screen. Greenware parts are made by cold-pressing the mixture that passes through the screen in steel tooling at 5,000 psi (35 MPa). The cold-pressed parts are cold isostatically pressed at 30,000 psi (210 MPa). The resultant parts are thermally processed, as disclosed herein, to dewax, remove metal oxides from, and partially sinter the greenware. The dewaxed greenware is wrapped in graphite foil, placed into a glass pocket fluid die (isostatic die assembly), preheated at 10° C./minute to 1800° C., held at that temperature for 15 minutes and then isostatically pressed (subjected to rapid omnidirectional compaction (ROC)) at 120,000 psi (830 MPa) for 20 seconds using a forging press. The fluid die is cooled in air and the parts are recovered.

The recovered parts have the following properties: Density—15.95 g/cm$^3$ (99.0% of theoretical based upon a linear rule of mixtures); Hardness (Rockwell A) 94.8; Hardness (Vickers, 70 pound (32 kg) load) 2412 kg/mm$^2$; Palmqvist Toughness (W) 30.6 kg/mm; and Hot Hardness (1200° C.) 11.99 GPa.

EXAMPLE 2

The procedure of Example 1 is duplicated, save for reducing the preheat temperature from 1800° C. to 1650° C., for a 380 gram quantity of the tungsten carbide/rhenium mixture. The recovered parts)have a density of 16.02 g/cm$^3$ (99.4% of theoretical) and a Wear Number (ASTM G-65), using wear bars having a length of 1.5 inch (3.8 cm) rather than 3 inches (7.6 cm), of 910$^{cm-3}$.

EXAMPLES 3–6

The procedure of Example 1 is replicated for tungsten carbide/rhenium metal mixtures having different rhenium metal contents and either the same or different preheat temperatures. The rhenium metal contents and preheat temperatures are shown in the following Table together with density, Vickers Hardness, and Palmqvist Toughness values for the densified parts. Data from Example 1 is included for comparison.

| Example Number | Rhenium Content (%) | Preheat Temperature (°C.) | Density (% Theoretical) | Vickers Hardness (kg/mm$^2$) | Palmqvist Toughness (kg/mm) | Fracture Toughness (MPa · m$^{1/2}$) |
|---|---|---|---|---|---|---|
| 1 | 12.48 | 1800 | 99.0. | 2412 | 30.6 | 7.3 |
| 3 | 6 | 1650 | 99.0 | 2453 | 20.8 | 6.1 |
| 4 | 6 | 1800 | 98.9 | 2380 | 20.1 | 5.9 |
| 5 | 18 | 1650 | 98.9 | 2306 | 21.5 | 6.0 |
| 6 | 18 | 1800 | 99.3 | 2357 | 19.2 | 5.8 |

The data from the Table demonstrate that pure rhenium metal serves as an effective binder for tungsten carbide, at least in the amounts shown in the Examples. Similar results are expected with greater amounts of rhenium up to 25 percent by weight of composition. Similar results are also expected when hafnium carbide or titanium carbide is substituted for tungsten carbide.

What is claimed is:

1. A dense refractory composition consisting of rhenium in an amount within a range of from 1 to 25 percent by weight of composition and a refractory metal carbide selected from tungsten carbide, hafnium carbide and titanium carbide in an amount within a range of from 75 to 99 percent by weight of composition, the amounts of rhenium and refractory metal carbide totaling 100 percent.

2. The composition of claim 1 wherein the refractory metal carbide is tungsten carbide in an amount within a range of from 80 to 95 percent by weight of composition and the amount of rhenium is from 5 to 20 percent by weight of composition.

3. The composition of claim 1 wherein the refractory metal carbide is tungsten carbide in an amount within a range of from 82 to 94 percent by weight of composition and the amount of rhenium is from 6 to 18 percent by weight of composition.

4. The composition of claim 2 having a density of greater than 98 percent of theoretical density, based upon a linear rule of mixtures, a hardness (Rockwell A) greater than 90 and a wear number (ASTM G-65) greater than $800^{cm-3}$.

* * * * *